United States Patent [19]

Mizuno

[11] Patent Number: 4,763,676

[45] Date of Patent: Aug. 16, 1988

[54] LIQUID DISPENSER

[75] Inventor: William G. Mizuno, Saint Paul, Minn.

[73] Assignee: Ecolab Inc., St. Paul, Minn.

[21] Appl. No.: 4,840

[22] Filed: Jan. 9, 1987

Related U.S. Application Data

[63] Continuation of Ser. No. 679,318, Dec. 7, 1984, abandoned.

[51] Int. Cl.[4] ..... B08B 13/00

[52] U.S. Cl. ..... 134/100; 134/101; 222/361

[58] Field of Search ..... 134/93, 100, 101; 222/57, 67, 361, 362, 365

[56] References Cited

U.S. PATENT DOCUMENTS

| | | | |
|---|---|---|---|
| 647,362 | 4/1900 | Beck | 222/365 X |
| 924,046 | 6/1909 | Ellman | 222/365 X |
| 933,528 | 9/1909 | Bruce | 222/365 X |
| 1,233,656 | 7/1917 | Fetner | 222/365 X |
| 1,974,789 | 9/1934 | Angell | 222/365 |
| 2,122,216 | 6/1938 | Seawell | 222/365 X |
| 2,226,096 | 12/1940 | Halsey | 134/94 X |
| 2,243,454 | 5/1941 | Collinge et al. | 222/365 X |
| 2,573,787 | 11/1951 | de ganahl et al. | 134/98 |
| 2,587,388 | 2/1952 | Ryder, Jr. | 4/227 |
| 2,671,037 | 3/1954 | Stoddard | 134/25 |
| 2,972,434 | 2/1961 | James | 222/66 |
| 2,991,911 | 7/1961 | Spain | 222/67 |
| 3,073,490 | 1/1963 | Dahl et al. | 222/453 |
| 3,159,317 | 12/1964 | Mini | 222/365 X |
| 3,204,821 | 9/1965 | Fann | 222/57 X |
| 3,223,284 | 12/1965 | Fann | 222/57 |
| 3,823,853 | 7/1974 | Alden | 222/361 |
| 3,907,167 | 9/1975 | Zanardo | 222/57 |
| 3,907,173 | 9/1975 | Lind | 222/330 |

FOREIGN PATENT DOCUMENTS

| | | | |
|---|---|---|---|
| 1548940 | 10/1970 | Fed. Rep. of Germany . | |
| 1338561 | 8/1963 | France | 222/365 |
| 2415796 | 8/1979 | France | 222/365 |

*Primary Examiner*—Harvey C. Hornsby
*Assistant Examiner*—Frankie L. Stinson
*Attorney, Agent, or Firm*—Merchant, Gould, Smith, Edell, Welter & Schmidt

[57] ABSTRACT

A liquid dispenser (10) for dispensing a liquid (16) from a reservoir (15) to a dispensing location is disclosed. The dispenser (10) includes a dispenser head member (11) adapted for engaging the reservoir (15). The head member (11) has a bore (18) having a first opening (18*a*) and second opening (18*b*). The first opening (18*a*) is proximate the reservoir (15) and the second opening (18*b*) is proximate the dispensing location. A stem member (19) is slideably mounted in the bore (20). The stem member (19) has a measuring cavity (21). The measuring cavity (21) is in fluid communication (15) when in a filling position wherein the liquid enters the measuring cavity and the measuring cavity (21) dispenses a given volume of product (16) from the measuring cavity (21) when in the dispensing position and when in a position intermediate the dispensing and filling positions the measuring cavity (21) is enclosed by the head member (11). A return spring (28) cooperatively connected to the first end of the stem member (19) and a cup (39) is cooperatively connected to the bottom of the stem member (19). The return spring (28) and cup (39) provide for moving the stem member (19) between a filling position and dispensing position based on the rise and fall of water caused by the spray action of a dishwasher.

21 Claims, 4 Drawing Sheets

LIQUID DISPENSER

This is a continuation of application Ser. No. 679,318, filed 12/7/84, now abandoned.

BACKGROUND OF THE INVENTION

1. Field of the Invention

This invention relates generally to liquid dispensers and more particularly to liquid dispensers that are activated by the rise and fall of a level of water in a reservoir or cup of an apparatus during the spray action of the wash arm of a dishwasher.

2. Description of the Prior Art

Domestic dishwashing machines are typically supplied with a rinse additive by one of two means. The first is through a solid rinse additive that is eroded during a spray cycle of the dishwashing machine, thereby providing a rinse additive solution to the water in the dishwashing machine. Other domestic washing machines, typically the top of the line models, have a built-in liquid rinse additive dispenser. The rinse additive dispenser is wired to a timer in the dishwashing machine to inject a pre-set amount of liquid rinse additive into the final rinse to minimize spotting and enhance drying.

The liquid rinse dispensers may fail after several years of use. In high/hard solids water, the user may notice a deterioration of the washing results immediately, but in softer waters, it may take a number of cycles for the deterioration of results to show up when the dispenser fails. As a result, many rinse additive injectors are neglected, resulting in the rinse additive not being added to the dishwashing machines with the resultant increase in spotting and filming and longer drying. Further, it is costly to have a repairman come into the house to service the malfunctioning dispenser, so often the use of the liquid rinse additive dispensers are discontinued by many users.

To date, applicant is unaware of any suitable liquid dispensers for rinse additive for use with a dishwashing machine which may be readily installed by the user. In U.S. Pat. No. 2,226,096, issued Dec. 24, 1940 to N. W. Halsey, a detergent dispenser for washing machines is disclosed. The detergent dispenser is activated by the water in the washing machine. However, the dispenser is not adapted for repetitive dispensing of detergent without refills after each use.

In a non-related field, that of dispensing a concentrated liquid into a tank of a toilet, dispensers are used to repeatedly dispense a small level of liquid with each flush of the toilet. One example of such a dispenser is seen in U.S. Pat. No. 3,841,524, issued Oct. 15, 1974 to Arvard Easter. The automatic liquid dispenser is for an inverted bottle of concentrated liquid. The dispenser has a top seal and a bottom seal, such that when the float is lowered the bottom seal opens, allowing the liquid within a hollow member to be dispensed. At the same time, the top seal is closing, preventing additional liquid from entering into the hollow member.

SUMMARY OF THE INVENTION

The present invention is a liquid dispenser for dispensing a liquid from a reservoir to a dispensing location. The dispenser includes a dispenser head member adapted for engaging the reservoir. The head member has a bore having a first opening and a second opening. The first opening is proximate the reservoir and the second opening is proximate the dispensing location. A stem member is slideably mounted in the bore of the head member. Also provided is a means for moving the stem member between a filling position and a dispensing position. The stem member has a measuring cavity in fluid communication with the reservoir when in the filling position wherein the liquid enters the measuring cavity. The measuring cavity dispenses a given volume of the liquid from the measuring chamber when in the dispensing position. When in a position intermediate the dispensing and filling positions, the measuring cavity is enclosed by the head member. A first seal is cooperatively connected to the stem member and positioned above the measuring chamber. A second seal is cooperatively connected to the stem member and positioned below the measuring chamber, whereby the first seal is engaged when the stem member is at its lowest position and the second seal is engaged when the stem member is in its uppermost position.

In a preferred embodiment, the means for moving the stem member is activated by the spray of water during a cycle in a dishwasher. In one embodiment, a cup is cooperatively connected to the bottom portion of the stem member. The cup has an open top for receiving water from the spray action of the dishwasher. At the bottom of the cup is a hole to allow water to drain out of the cup. Water enters the opening at the top of the cup faster than water flows out of the hole, thereby accumulating water in the cup, causing the stem to move downward. A return spring is cooperatively connected to the upper portion of the stem member to provide a return force to bring the stem to its upper position after water has drained out of the opening of the cup.

In a second embodiment, the dispensing action is 180° out of phase with that of the first embodiment. That is, the spray action of the dishwasher causes the stem member to move upward and upon the completion of the wash action, the stem member moves downward, to the dispensing position. In the second embodiment, a float is cooperatively connected to the bottom of the stem member. Encompassing the float is a housing for the accumulation of water from the spray action of the dishwasher. Therefore, depending upon at which time in the cycle a person wishes to dispense the product, either the first or second embodiment may be used.

DESCRIPTION OF THE PREFERRED EMBODIMENT

Figure 1:
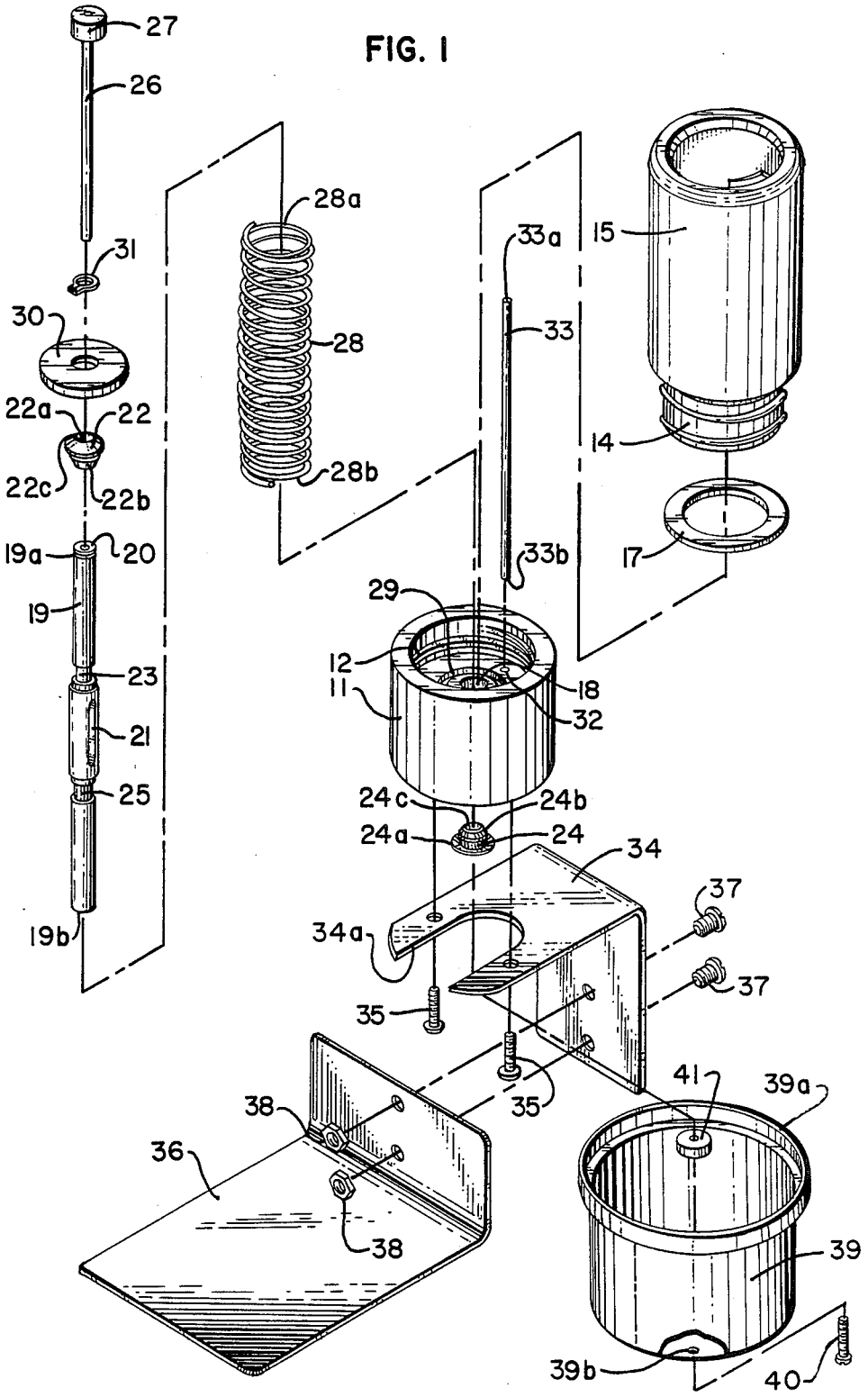
FIG. 1 is an exploded perspective view of the dispenser incorporating my present invention.

Referring to the drawing, wherein like numerals represent like parts throughout the several views, there is generally disclosed at 10 a liquid dispenser. The dispenser 10 includes a dispenser head member 11 having a top opening 12. The opening 12 has threaded members 13 adapted to receive the threaded neck 14 of the supply bottle 15. The product 16 to be dispensed is contained in the supply bottle 15. An o-ring 17 is positioned at the bottom of the opening 12 to further create a seal between the head member 11 and bottle 15.

A bore 18 extends through the head member 11. The bore 18 has a first opening 18*a* proximate the supply bottle/reservoir 15 and a second opening 18*b* proximate the location where the product 16 is dispensed.

A stem member 19 has a first end 19*a* and a second end 19*b*. The stem member 19 has a bore 20 that extends from its first end 19*a* to a measuring cavity 21. A first seal 22 is cooperatively connected to an indentation 23 above the measuring cavity 21. A second seal 24 is cooperatively connected to a second indentation 25 below the measuring cavity 21. The first seal 22 is identical to the second seal 24, except for its orientation. The first seal 22 has the umbrella portion 22*a* positioned upward, while the second seal 24 has the umbrella portion 24*a* positioned downward. The base portions 22*b* and 24*b* have an outer diameter that is equal to or slightly less than the inner diameter of the bore 18. The umbrella portion 22*a* and 24*a* has a diameter that is larger than the diameter of the bore 18, so that the seals 22 and 24 may effect a seal over the openings 18*a* and 18*b*. Each seal 22 and 24 has an opening 22*c* and 24*c* extending through the seal. The seal is of a structurally flexible material and the openings 22*c* and 24*c* are simply expanded to slip over the stem 19 down to the indentations 23 and 25. The seals 22 and 24 are made of a material resistant to the product 16 to be dispensed. The base portions 22*b* and 24*b* then are positioned over the indentations 23 and 25. An adjusting rod 26 is slideable inside of the bore 20 and can extend into the measuring cavity 21. The volume of the measuring cavity 21 that is able to be filled with liquid can therefore be adjusted by moving the adjusting rod 26 up and down inside of the bore 20. A knob 27 is attached to the top of the adjusting rod 26 to provide for easy adjustment of the height of the adjusting rod 26. The adjusting rod has a friction fit in the bore 20 so when the adjusting rod is moved up and down, friction will hold the rod 26 in place. A return spring 28 is positioned around the stem 19 and its bottom end 28*b* is seated in an annular groove 29 in the head member 11. A retaining collar 30 is placed over the stem 19 and secured from further upward movement by snap ring 31. An annular groove 30*a* is provided on the underneath side of the retaining collar 30 and provides a seat 30*a* for the top end 28*a* of the return spring 28.

Figure 2:
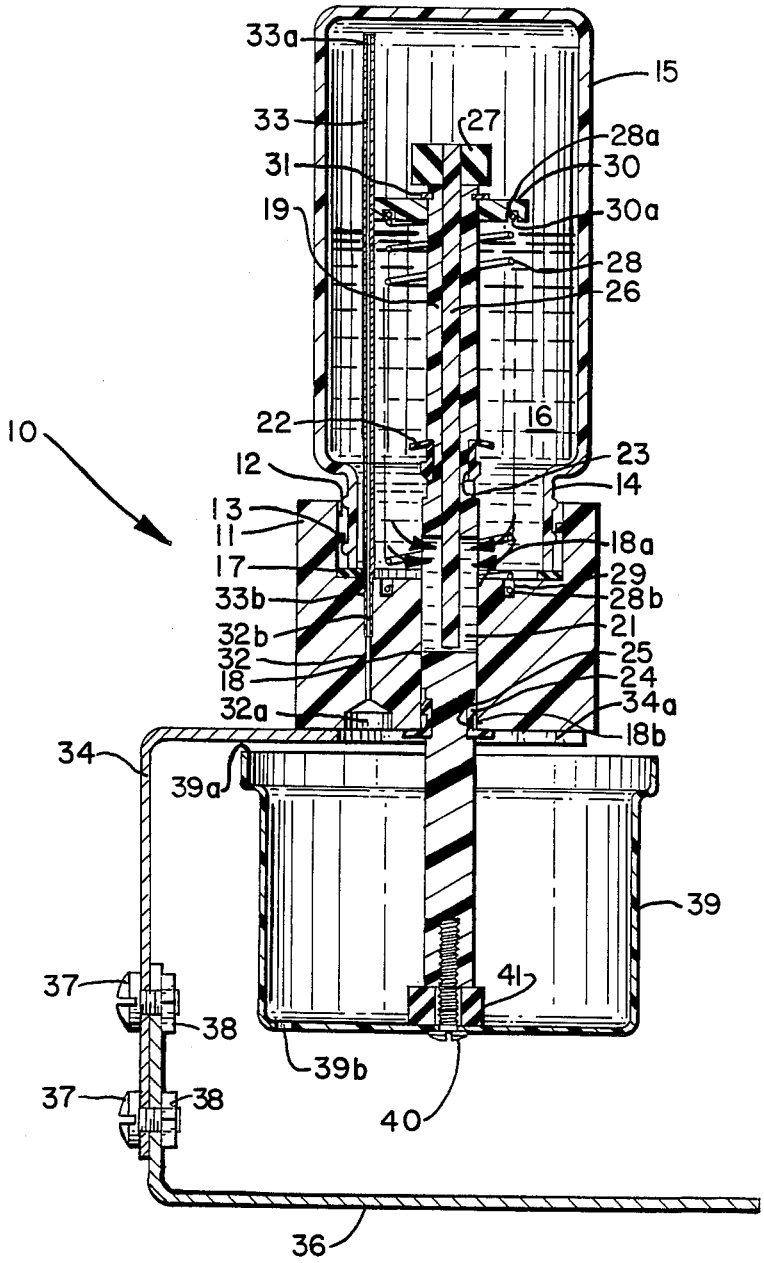
FIG. 2 is a cross-sectional view of the dispenser in FIG. 1.

A venting passageway 32 extends through the head member 11. The first end 32*a* of the vent passage 32 is open to atmospheric air and the second end 32*b* terminates at the top opening 12. A vent tube 33 is inserted into the second end 32*b* to extend the vent passageway to the top of the bottle 15, as viewed in FIG. 2. The vent tube 33 has an inner bore 33*a* so that atmospheric air is able to enter the first end 32*a* and enter that portion of the bottom 15 that does not have product 16 in it. The vent tube 33 simply has a friction fit in the vent passageway 32 and does provide a liquid tight seal when it is inserted into the first end 32*b*.

The head member 11 is cooperatively connected to a mounting bracket 34 by means of two screws 35. The head member 11 is mounted such that the stem member 19 is free to pass up and down through a slot 34*a* in the mounting bracket 34. A bottom plate 36 is cooperatively connected to the mounting bracket 34 by screws 37 and nuts 38. The mounting plate 38 is adapted to be placed in a dishwasher, such as on the bottom dishwashing rack so that the dispenser 10 is positioned in an upright position, as shown in FIG. 1 in the dishwasher. A cup 39 is cooperatively connected to the bottom of the stem member 19 by means of screw 40 and washer 41. The stem member 19 has a threaded hole in which the screw 40 is inserted. The cup 39 has an open top 39*a* and a bottom opening 39*b*.

In a second embodiment liquid dispenser 110 is provided that has a dispensing cycle 180° out of phase as that described in the first embodiment of the liquid dispenser 10. The dispenser 110 includes a dispenser head member 111 having a top opening 112. The opening 112 has threaded members 113 adapted to receive the threaded neck 114 of a supply bottle 115. The product 116 to be dispensed is contained in the supply bottle 115. An o-ring 117 is positioned at the bottom of the opening 112 to further create a seal between the head member 11 and bottle 115.

A bore 118 extends through the head member 111. The bore 118 has a first opening 118*a* proximate the supply bottle/reservoir 115 and a second opening 118*b* proximate the location where the product 116 is dispensed.

A stem member 119 has a first end 119*a* and a second end 119*b*. The stem member 119 has a bore 120 that extends from its first end 119*a* to a measuring cavity 121. A first seal 122 is cooperatively connected to an indentation 123 above the measuring cavity 121. The first seal 122 is identical to the second seal 124, except for its orientation. The first seal 122 has an umbrella portion 122*a* positioned upward, while the second seal 124 has the umbrella portion 124*a* positioned downward. The base portions 122*b* and 124*b* have an outer diameter that is equal to or slightly less than the inner diameter of the bore 118. The umbrella portion 122*a* and 124*a* has a diameter that is larger than the diameter of the bore 118, so that the seals 122 and 124 may effect a seal over the openings 118*a* and 118*b*. Each seal 122 and 124 has an opening 122*c* and 124*c* extending through the seal. The seal is of a structurally flexible material and the openings 122*c* and 124*c* are simply expanded to slip over the stem 119 down to the indentations 123 and 125. The seals 122 and 124 are made of a material resistant to the product 116 to be dispensed. The base portions 122*b* and 124*b* are positioned over the indentations 123 and 125. An adjusting rod 126 is slideable inside of the bore 120 and can extend into the measuring cavity 121. The volume of the measuring cavity 121 that is able to be filled with liquid can therefore be adjusted by moving the adjusting rod 126 up and down inside the bore 120. A knob 127 is attached to the top of the adjusting rod 126 to provide for easy adjustment of the height of the adjusting rod 126. The adjusting rod has a friction fit in the bore 120 so when the adjusting rod is moved up and down, friction will hold the rod 126 in place.

A venting passageway 132 extends through the head member 111. The first end 132*a* of the vent passage 132 is open to atmospheric air and the second end 132*b* terminates at the top opening 112. A vent tube 133 is inserted into the second end 132*b* to extend the vent passageway to the top of the bottle 115, as viewed in FIG. 3. The vent tube 133 has an inner bore 133*a* so that atmospheric air is able to enter the first end 132*a* and enter that portion of the bottle 115 that does not have product 116 in it. The vent tube 133 simply has a friction fit in the vent passageway 132 and does provide a liquid tight seal when it is inserted into the first end 132*b*.

Figure 3:
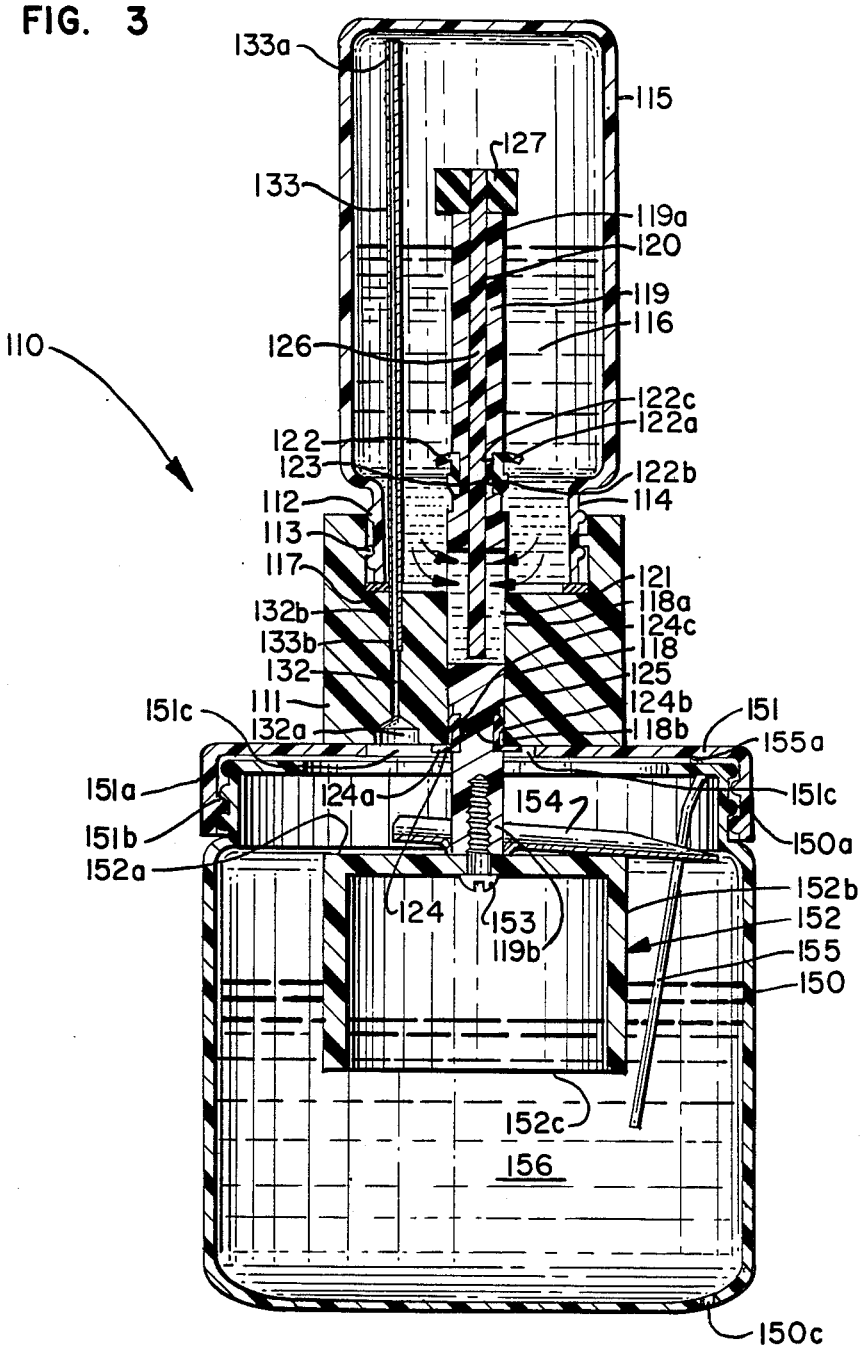
FIG. 3 is a cross-sectional view of a second embodiment of the dispenser of the present invention.

A cup 150 having an open top 150*b* and a threaded collar 150*a* is provided and is adapted to be placed in a dishwasher, such as the bottom dishwashing rack so that the dispenser 110 is positioned in an upright position, as shown in FIG. 3, in the dishwasher. The cup 150 also has a discharge opening 150*c*. The head member 111 is cooperatively connected to a cross support bracket 151. The cross support bracket has a flange 150*a* having threads 151*b* such that the cross support bracket may be secured to the cup 150 by simply screwing the cross support bracket threads 151*b* to the collar 150*a*. The width of the cross support bracket 151 may be any suitable width, as long as it provides proper support for the upper portion of the dispenser 110 and does not completely cover up the open top 150*b* of the cup 150. The head member 111 is cooperatively connected to the cross support member 151 by any suitable means. The cross support bracket 151 has an opening 151*c* so that the first end 132*a* of vent passageway 132 is open to atmospheric air and the stem member 119 is free to move up and down inside of the opening 151*c*. The stem member 119 is cooperatively connected to a float 152 by means of a screw 153. The float 152 has a top member 152*a* and downwardly depending sides 152*b*. The float 152 has an open bottom 152*c*.

Figure 4:
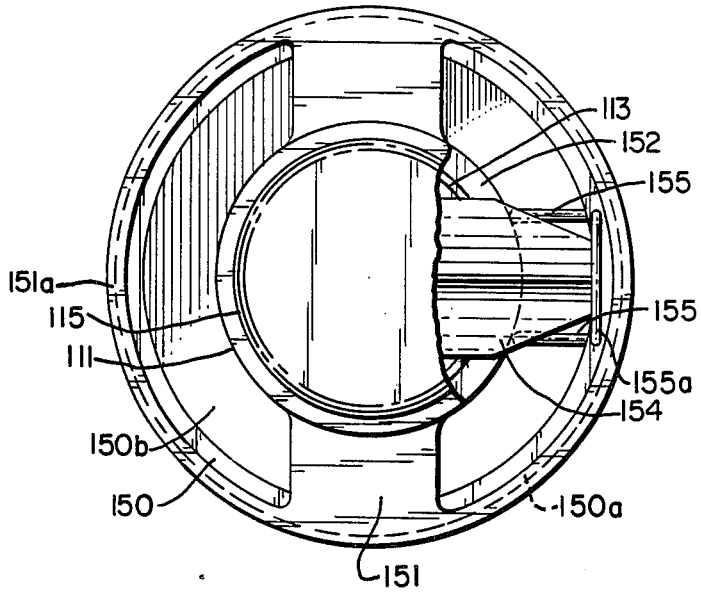
FIG. 4 is a top plan view of the dispenser in FIG. 3.

An open top discharge spout 154 is cooperatively connected to the stem member 119. This may be done in any suitable manner, such as having an opening in the spout 154 and simply sliding it around the stem member 119. As will be more fully discussed hereinafter, the spout 154 directs the product 116 that is being dispensed. Two wire members 155 are cooperatively connected to the cup 150. The spout 154 is positioned between the two wire members 155 to direct the discharge of the inclined spout 154. The two wire members 155 may be a one piece unit as shown in FIG. 4 with a cross member connecting them or two separate wires. As shown in FIG. 4, the wire members 155 are simply inserted through holes in the cup 150 and the cross member 155*a* holds the wires 155 in place.

It can be seen that the upper portion of the dispenser 110, that is that portion above the head member 111, is nearly identical to the upper portion of the dispenser 10, except for the lack of a return spring 28, collar 30, ring 31 and groove 29.

In operation, the dispenser 10 is placed inside of a dishwasher with the dispenser 10 resting on the base plate 38 on a dishwashing rack, or other suitable location. When the dispenser 10 is first placed in the dishwasher, there is no water in the cup 39. Therefore, the force of the spring 28 forces the stem member 19 upward. In this position, the product 16 flows into the measuring cavity 21, at least a portion of which is above the head member 11. The volume of the measuring cavity 21 may be adjusted by the movement up and down of the adjusting rod 26. The rod will take up a varying amount of space, depending upon its position, thereby reducing the volume that may be filled up by the product 16. When in the filling position, the bottom seal 24 seals against the opening 18*b*, preventing any leakage that may occur due to the dispenser 10 sitting in the filling position for a long period of time. Upon the activation of a spraying cycle in a dishwasher, water from the spraying arm of the dishwasher enters the top 39*a* of the cup 39. The water accumulates inside of the cup 39 because water is entering the top 39*a* faster than it exits the bottom opening 39*b*. After a sufficient amount of water has entered the cup to overcome the force of the spring 28, the cup 39 moves downward, sliding the stem member 19 downward within the bore 18. When the stem 19 is in a position intermediate the dispensing and filling positions, the measuring chamber 21 is enclosed by the head member 11. The tolerance between the outer diameter of the stem 19 around the measuring cavity 21 is very close to the diameter of the bore 18. Therefore, there is no leakage through the bore 18. The tolerance to which the outer diameter of the stem 19 and the bore 18 is typically within 0.002 inch. Due to the viscocity of the product to be dispensed, a rinse additive, the tolerance of 0.002 inch does not allow for leakage around the stem member 19. As the stem member 19 continues downward at least a portion of the measuring cavity 21 exits the head member 11, thereby allowing the product 16 to exit the measuring cavity 21. The product 16 is thereby dispensed into the cup 39 and exits along with the water through the bottom opening 39*b*. When the spraying cycle stops, the water and product 16 exit the bottom 39*b* and the force of the spring overcomes the weight of the cup only and the stem member moves upward to its filling position again. The cycle is then ready to be repeated upon the next spray action in the dishwashing machine. In a preferred embodiment, the supply bottle 15 is translucent such that it will be readily ascertainable to the user when it is necessary to add more rinse additive to the dispenser 10. The user will be able to be aware of the proper operation of the dispenser as it is in plain sight in the dishwasher, as opposed to the prior art dispensers that were located in the door of the machine.

The venting system allows for maintaining atmospheric pressure within the bottle 15 while preventing any water from backing up into the reservoir 15 through the venting passageway 32 and bore 33*a*.

In operation, the dispenser 110 is placed inside of a dishwasher with the dispenser 110 resting on the cup 150 on a dishwashing rack, or other suitable location. When the dispenser 110 is first placed in the dishwasher, there is no water 156 in the cup 150. Therefore, the weight of the cup has the stem member 119 in a downward dispensing position. As the spray action of a dishwashing machine is initiated, the water 156 from the spray arm enters the open top 150*b* of the cup 50 at a rate faster than the water 156 can exit the discharge opening 150*c*. Therefore, the water level rises inside of the cup 150. As the water level rises, air is trapped inside of the float 152 and the float rises with the rise of water level in the cup 150. The rise of the float 152 causes the stem member 159 to move upward to a filling position. In the filling position, the product 116 flows into the measuring cavity 121, at least a portion of which is above the head member 111. The volume of the measuring cavity 121 may be adjusted by movement up and down of the adjusting rod 126. When in the filling position, the bottom seal 124 seals against the opening 118*b*. When the spraying cycle in the dishwasher ceases, water will cease coming in the open top 150*b* and the water level will descend as the water exits the discharge opening 150*c*. As the float 152 lowers itself with the lowering of the water level, the stem member 119 is moved downward to a dispensing position. When the stem 119 is in a position intermediate the dispensing and filling position, the measuring chamber 121 is enclosed by the head member 111. The stem member 119 and bore 118 have tolerances similar to those discussed for the dispenser 10. As the stem member 119 continues downward, at least a portion of the measuring cavity 121 exits the head member 111, thereby allowing the product 116 to exit the measuring cavity 121. The product 116 is thereby dispensed onto the open top of the downwardly inclined spout 154. The spout 154 directs the product 116 around the float 152 and the product 116 is dropped into the cup 150. The cycle is then ready to be repeated upon the next spray action in the dishwashing machine. In a preferred embodiment, the supply bottle 115 is translucent.

The venting system allows for maintaining atmospheric pressure within the bottle 115 while preventing any water from backing up into the reservoir 115 through the vending passageway 132 and bore 133*a*.

Other modifications of the invention will be apparent to those skilled in the art in light of the foregoing description. This description is intended to provide specific examples of individual embodiments which clearly disclose the present invention. Accordingly, the inventions are not limited to these embodiments or the use of elements having specific configurations and shapes as presented herein. All alternative modifications and variations of the present invention which follow in the spirit and broad scope of the appended claims are included.

What is claimed is:

1. A liquid dispenser for dispensing a measured quantity of liquid from a reservoir to a dispensing location, said dispenser comprising:

(a) a dispenser head member adapted for engaging the reservoir, said head member having a bore having a first opening and a second opening, said first opening proximate the reservoir and said second opening proximate the dispensing location;

(b) a stem member slideably mounted in said bore of said head member;

(c) means for moving said stem member between a filling position and a dispensing position said moving means having movement depending on a rise and fall of a level of water;

(d) said stem member having a measuring cavity, said measuring cavity in fluid communication with the reservoir when in said filling position wherein the liquid enters said measuring cavity, and said measuring cavity having a constant volume during dispensing and dispensing a given volume of the liquid from said measuring cavity when in said dispensing position and when in a position intermediate said dispensing and filling positions said measuring cavity is enclosed by said head member and when in said dispensing position a portion of said measuring cavity exits said head member and retains a constant volume, shape, and configuration;

(e) a first umbrella seal cooperatively connected to said stem member and positioned above said measuring cavity; and (f) a second umbrella seal cooperatively connected to said stem member and positioned below said measuring cavity, whereby said first umbrella seal is engaged when said stem member is at its lowest position and said second umbrella seal is engaged when said stem member is in its uppermost position.

2. The liquid dispenser of claim 1, further comprising:

(a) a return spring having a first end cooperatively connected to said stem member, and a second end not cooperatively connected to said stem member, wherein when said stem member moves downward on a dispensing stroke, said spring is compressed; and (b) a cup having an inner cavity, said cup cooperatively connected to said stem member, said inner cavity having an entrance opening and an exit opening to allow water to enter said inner cavity and accumulate during a spray action of a dishwasher, wherein said cup moves downward, overcoming said spring member, and moving said stem member downward, and when the spray action is completed the water exists through said exit opening of said cup allowing said spring to move said stem member upward to said filling position.

3. The liquid dispenser of claim 1, further comprising:

(a) a float cooperatively connected to said stem;

(b) a cup with an open top having an inner cavity, said float positioned in said inner cavity and said cup having a discharge opening; and (c) means for supporting said head member above said cup, wherein water from a spray action of a dishwasher enters said inner cavity through said open top of said cup causing the water level to rise and therefore said float to rise, moving said stem upward to a filling position and when the spray action stops, said float is lowered and therefore said stem lowers to the dispensing position.

4. The liquid dispenser of claim 1, further comprising means to adjust the volume of liquid to be dispensed.

5. The liquid dispenser of claim 4, wherein said adjusting means comprises:

(a) said stem member having a bore, said bore entering said measuring chamber; and (b) an adjusting rod slideable in said bore, wherein said rod may be moved to enter said measuring cavity, thereby decreasing the volume of said measuring cavity that is filled with the liquid.

6. The liquid dispenser of claim 1, further comprising means for venting the reservoir to atmospheric air.

7. The liquid dispenser of claim 6, wherein said venting means comprises:

(a) a passageway in said head member, said passageway having a first end open to atmospheric air and a second end; and (b) a vent tube having first and second ends, said tube position in the dispenser and said first end of said tube cooperatively connected to said second end of said passageway and a second end extending proximate a top of the reservoir, above the level of liquid in the reservoir.

8. A liquid dispenser for dispensing a measured quantity of liquid from a reservoir to a dispensing location, said dispenser comprising:

(a) a dispenser head member adapted for engaging the reservoir, said head member having a bore having a first opening and a second opening, said first opening proximate said reservoir and said second opening proximate the dispensing location;

(b) a stem member slideably mounted in said bore of said head member;

(c) means for moving said stem member between a filling position and a dispensing position;

(d) said stem member having a measuring cavity, said measuring cavity having a constant volume during dispensing in fluid communication with the reservoir when in said filling position wherein the liquid enters said measuring cavity, and said measuring cavity dispensing a given volume of the liquid from said measuring cavity when in said dispensing position and when in a position intermediate said dispensing and filling positions said measuring cavity is enclosed by said head member and when in said dispensing position a portion of said measuring cavity exits said head member;

(e) a first umbrella seal cooperatively connected to sid stem member and positioned above said measuring chamber;

(f) a second umbrella seal cooperatively connected to said stem member and positioned below said measuring chamber, whereby said first umbrella seal is engaged when said stem member is at its lowest position and said second umbrella seal is engaged when said stem member is in its uppermost position;

(g) wherein said moving means has movement depending on a rise and fall of a level of water;

(h) means to adjust the volume of liquid to be dispensed; and (i) means for venting the reservoir to atmospheric air.

9. The liquid dispenser of claim 8, further comprising:

(a) a return spring having a first end cooperatively connected to said stem member, and a second end not cooperatively connected to said stem member, wherein when said stem member moves downward on a dispensing stroke, said spring is compressed; and (b) a cup having an inner cavity, said cup cooperatively connected to said stem member, said inner cavity having an entrance opening and an exit opening to allow water to enter said inner cavity and accumulate during a spray action of a dishwasher, wherein said cup moves downward, overcoming said spring member, and moving said stem member downward, and when the spray action is completed the water exits through said exit opening of said cup allowing said spring to move said stem member upward to said filling position.

10. The liquid dispenser of claim 8, further comprising:

(a) a float cooperatively connected to said stem; and (b) a cup with an open top having an inner cavity, said float positioned in said inner cavity and said cup having a discharge opening.

11. (Three times amended) A liquid dispenser for dispensing a measured quantity of liquid to a dispensing location, said dispenser positioned in a dishwasher, said dispenser comprising:

(a) a supply bottle having a reservoir for containing the liquid to be dispensed;

(b) a dispenser head member adapted for engaging said reservoir, said head member having a bore having a first opening and a second opening, said first opening proximate the reservoir and said second opening proximate the dispensing location;

(c) a stem member slideably mounted in said bore of said head member;

(d) means for moving said stem member between a filling position and a dispensing position said moving means having movement depending on a rise and fall of a level of water;

(e) said stem member having a measuring cavity, said measuring cavity having a constant volume during dispensing and in fluid communication with said reservoir when in said filling position wherein the liquid enters said measuring cavity, and said measuring cavity dispensing a given volume of the liquid from said measuring cavity when in said dispensing position and when in a position intermediate said dispensing and filling positions said measuring cavity is enclosed by said head member and when in said dispensing position a portion of said measuring cavity exits said head member and retains a constant volume, shape, and configuration;

(f) a first umbrella seal cooperatively connected to said stem member and positioned above said measuring cavity; and (g) a second umbrella seal coperatively connected to said stem member and positioned below said measuring cavity, whereby said first umbrella seal is engaged when said stem member is at its lowest position and said second umbrella seal is engaged when said stem member is in its uppermost position.

12. The liquid dispenser of claim 11, further comprising:

(a) a return spring having a first end cooperatively connected to said stem member, and a second end not cooperatively connected to said stem member, wherein when said stem member moves downward on a dispensing stroke, said spring is compressed; and (b) a cup having an inner cavity, said cup cooperatively connected to said stem member, said inner cavity having an entrance opening and an exit opening to allow water to enter said inner cavity and accumulate during a spray action of a dishwasher, wherein said cup moves downward, overcoming said spring member, and moving said stem member downward, and when the spray action is completed the water exits through said exit opening of said cup allowing said spring to move said stem member upward to said filling position.

13. The liquid dispenser of claim 11, further comprising:

(a) a float cooperatively connected to said stem;

(b) a cup with an open top having an inner cavity, said float positioned in said inner cavity and said cup having a discharge opening; and (c) means for supporting said head member above said cup, wherein water from a spray action of the dishwasher enters said inner cavity through said open top of said cup causing the water level to rise and therefore said float to rise, moving said stem upward to a filling position and when the spray action stops, said float is lowered and therefore said stem lowers to the dispensing position.

14. The liquid dispenser of claim 11, further comprising means to adjust the volume of liquid to be dispensed.

15. The liquid dispenser of claim 14, wherein said adjusting means comprises:

(a) said stem member having a bore, said bore entering said measuring chamber; and (b) an adjusting rod slideable in said bore, wherein said rod may be moved to enter said measuring cavity, thereby decreasing the volume of said measuring cavity that is filled with the liquid.

16. The liquid dispenser of claim 11, further comprising means for venting said reservoir to atmospheric air.

17. The liquid dispenser of claim 16, wherein said venting means comprises:

(a) a passageway in said head member, said passageway having a first end open to atmospheric air and a second end; and (b) a vent tube having first and second ends, said tube position in the dispenser and said first end of said tube cooperatively connected to said second end of said passageway and a second end extending proximate a top of said reservoir, above the level of liquid in said reservoir.

18. The liquid dispenser of claim 11, wherein said supply bottle is translucent.

19. A liquid dispenser for dispensing a liquid to a dispensing location, said dispenser positioned in a dishwasher, said dispenser comprising:

(a) a supply bottle having a reservoir for containing the liquid to be dispensed;

(b) a dispenser head member adapted for engaging the reservoir, said head member having a bore having a first opening and a second opening, said first opening proximate said reservoir and said second opening proximate the dispensing location;

(c) a stem member slideably mounted in said bore of said head member;

(d) means for moving said stem member between a filling position and a dispensing position;

(e) said stem member having a measuring cavity, said measuring cavity having a constant volume during dispensing and in fluid communication with said reservoir when in said filling position wherein the liquid enters said measuring cavity, and said measuring cavity dispensing a given volume of the liquid from said measuring cavity when in said dispensing position and when in a position intermediate said dispensing and filling positions said measuring cavity is enclosed by said head member and when in said dispensing position a portion of said measuring cavity exits said head member;

(f) a first umbrella seal cooperatively connected to said stem member and positioned above said measuring chamber;

(g) a second umbrella seal cooperatively connected to said stem member and positioned below said measuring chamber, whereby said first umbrella seal is engaged when said stem member is at its lowest position and said second umbrella seal is engaged when said stem member is in its uppermost position;

(h) wherein said moving means has movement depending on a rise and fall of a level of water;

(i) means to adjust the volume of liquid to be dispensed; and (j) means for venting the reservoir to atmospheric air.

20. The liquid dispenser of claim 19, further comprising:

(a) a return spring having a first end cooperatively connected to said stem member, and a second end not cooperatively connected to said stem member, wherein when said stem member moves downward on a dispensing stroke, said spring is compressed;

(b) a cup having an inner cavity, said cup cooperatively connected to said stem member, said inner cavity having an entrance opening and an exit opening to allow water to enter said inner cavity and accumulate during a spray action of a dishwasher, wherein said cup moves downward, overcoming said spring member, and moving said stem member downward, and when the spray action is completed the water exits through said exit opening of said cup allowing said spring to move said stem member upward to said filling position.

21. The liquid dispenser of claim 19, further comprising:

(a) a float cooperatively connected to said stem; and (b) a cup with an open top having an inner cavity, said float positioned in said inner cavity and said cup having a discharge opening.

* * * * *